US006106234A

United States Patent [19]

Gabbitas

[11] Patent Number: 6,106,234

[45] Date of Patent: Aug. 22, 2000

[54] ROTARY ASSEMBLY

[75] Inventor: John S L Gabbitas, Bristol, United Kingdom

[73] Assignee: Rolls-Royce PLC, London, United Kingdom

[21] Appl. No.: 09/179,390

[22] Filed: Oct. 27, 1998

[30] Foreign Application Priority Data

Dec. 3, 1997 [GB] United Kingdom ..... 9725473

[51] Int. Cl.[7] ..... F01D 5/32

[52] U.S. Cl. ..... 416/221; 416/220 R; 416/96 R

[58] Field of Search ..... 416/219 R, 220 R, 416/221, 248, 95, 96 R, 96 A, 97 R; 415/115, 116, 173.7, 173.4, 173.5, 174.4, 174.5

[56] References Cited

U.S. PATENT DOCUMENTS

| | | | |
|---|---|---|---|
| 4,558,988 | 12/1985 | Kisling et al. | 416/220 R |
| 5,018,943 | 5/1991 | Corsmeier et al. | 416/220 R |
| 5,302,086 | 4/1994 | Kulesa et al. | 416/221 |
| 5,318,405 | 6/1994 | Meade et al. | 416/220 R |
| 5,320,488 | 6/1994 | Meade et al. | 415/173.7 |
| 5,338,154 | 8/1994 | Meade et al. | 415/173.7 |
| 5,472,313 | 12/1995 | Quinones et al. . | |
| 5,622,475 | 4/1997 | Hayner et al. . | |

FOREIGN PATENT DOCUMENTS

| | | |
|---|---|---|
| 928349 | 6/1963 | United Kingdom . |
| 2 058 945 | 4/1981 | United Kingdom . |
| 2 244 100 | 11/1991 | United Kingdom . |

*Primary Examiner*—Christopher Verdier
*Attorney, Agent, or Firm*—Oliff & Berridge, PLC

[57] ABSTRACT

A rotary assembly of a turbine stage of a gas turbine engine comprising a disc carrying internally air cooled blades around its periphery has a cover plate of one face of the disc to create a plenum for a cooling air supply to the blades. The cover plate is fitted to the disc by means of an annulus of bayonet connections at a first radius and is retained at a second radius, less than the first radius, by a split ring arrangement. The split ring is fitted into a groove in the disc and engages an inner rim on the cover plate to restrain axial movement. An anti-rotation key is engaged in a slot in the cover plate and in the disc and is also retained by the split ring.

5 Claims, 2 Drawing Sheets

ROTARY ASSEMBLY

The invention relates to a rotary assembly. In particular the invention concerns a rotary disc assembly in the turbine section of a gas turbine engine.

Commonly a rotary turbine stage incorporates a cooling air system in which relatively cool air is conveyed over at least one face of the disc in a radially outward direction before it is introduced through channels or orifices near the periphery of the disc into an internal blade cooling system via the blade roots. A cover plate is carried on the said disc face to both create a cooling volume for the disc face and a plenum for the air flow into the blade roots. The cover plate is sealed against the disc face to avoid cooling air loss, and normally carries part of a further seal assembly co-operating with a stationary part on an adjacent stator stage. The design of the cover plate, therefore, requires stability, and dynamic balance, tolerance to differential thermal expansion between the disc and the cover plate. In addition, the cover plate must be positively located on the face of the disc but remain capable of being stripped and accurately rebuilt in the same angular position. These and other advantages of the invention will be apparent in the following description.

According to the present invention there is provided a rotary assembly comprising a disc, formed with a plurality of concentric features on one side thereof for mounting a cover plate by means of bayonet connections at a first radius and a split ring at a second radius including an anti-rotation key which engages with the disc the cover plate and the split ring.

In a preferred form of the invention the anti-rotation key is engaged with a slot formed in the face of the disc and with the ends of the split ring.

Preferably the bayonet connection is formed at a first, outer radius and the expanding split ring is located at a second, inner radius and is outwardly expanding. The disc is formed with a concentric feature at the second radius comprising an outward opening groove into which the outwardly expanding split ring may be contracted during assembly of the cover plate on the disc.

Figure 1:
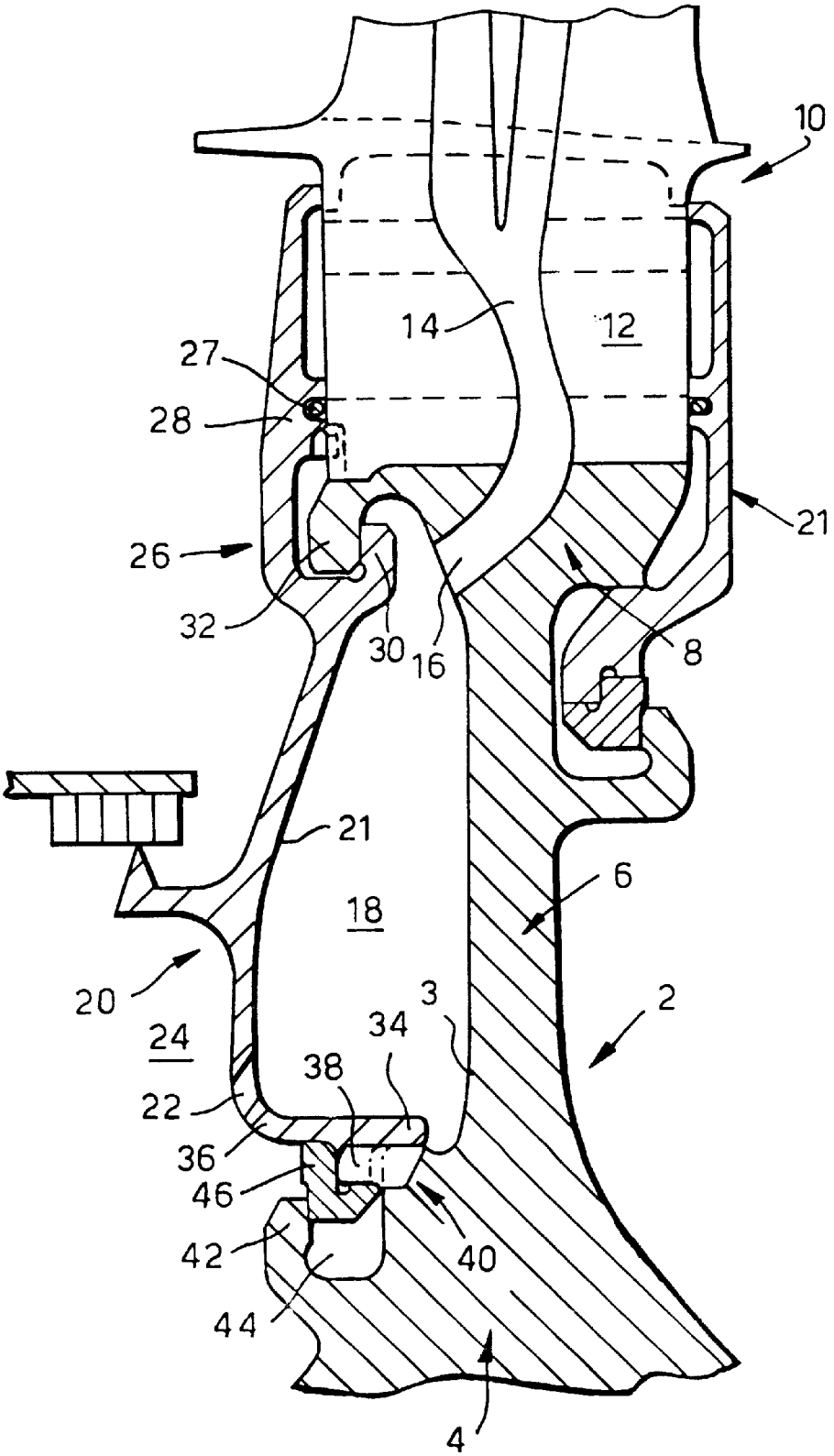
Figure 2:
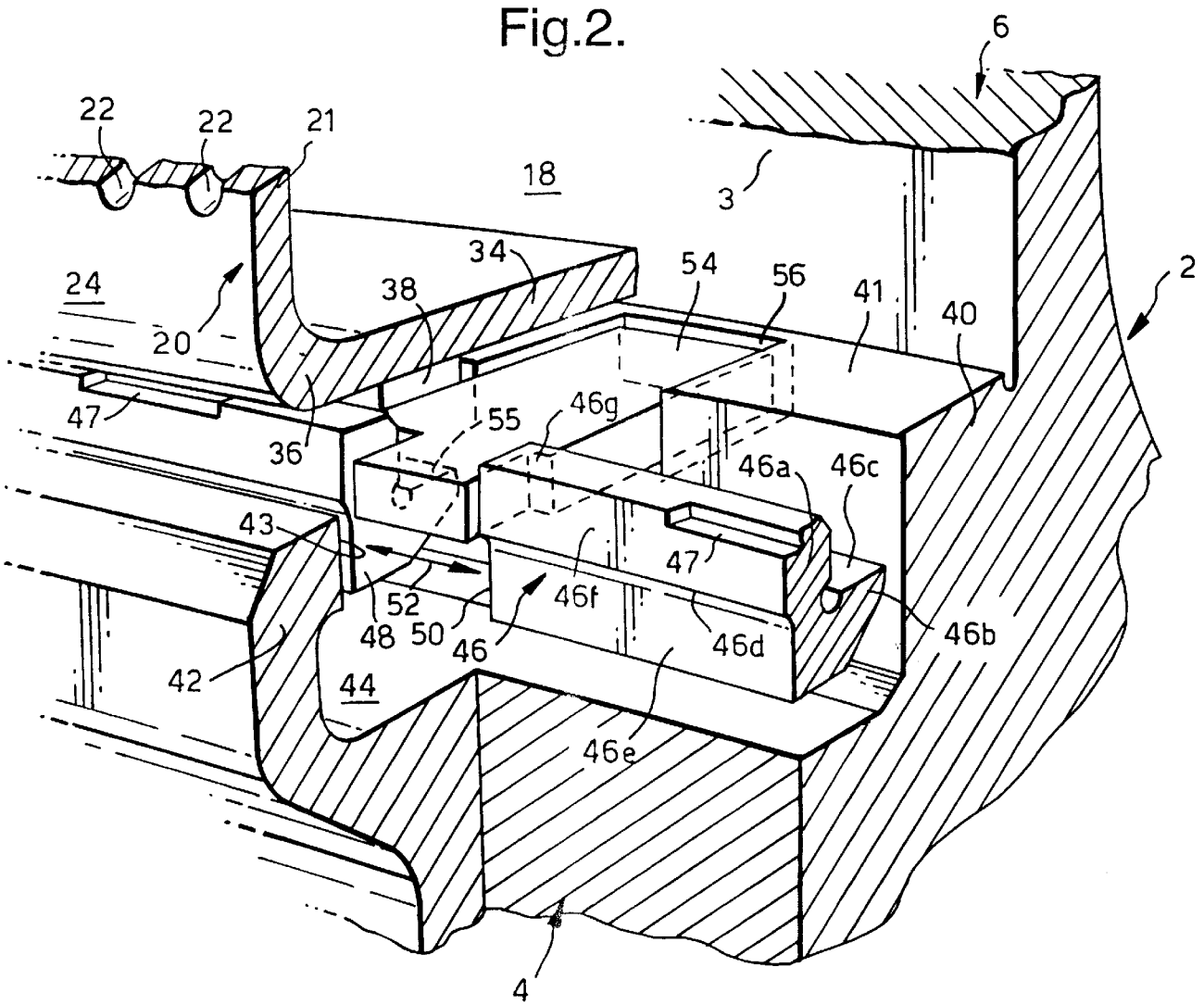

The invention will now be described in more detail with particular reference to one embodiment illustrated, by way of example only, in the accompanying drawings in which:

FIG. 1 shows a section through a disc, cover plate and its mounting arrangements, and FIG. 2 shows a part cutaway, perspective view of the split ring and anti-rotation key arrangement.

Referring firstly to FIG. 1 a disk (2) includes a hub portion (4) which is attached to an engine shaft (not shown), an annular web (6) and a rim portion (8). The disc rim (8) is slotted in well-known manner around its periphery to receive the roots of a plurality of blades spaced apart around the disc circumference. A single blade is shown in section at (10) revealing a blade root (12) having an internal passage (14) leading to an internal air cooling system in the airfoil section of the blade. Air is supplied to the blade passages (14) via further curved passageways (16) formed through the disc rim (8) to convey air from a plenum (18) adjacent the front face of the disc (2). Cooling air is continuously pumped into the plenum, during engine operation, through an annular array of pre-swirl holes (22) formed at intervals spaced apart circumferentially around an inward facing region in the hollow portion (21) of the cover plate (20). These holes (22) are angled inwardly in an axial direction and also circumferentially in the direction of rotation of the disc (2) so that air in the space (24) external to the cover plate (20) is pumped through the holes (22) by the differential pressure head and by a ram effect due to the rotation of the cover plate (20) carried by the disc (2).

The plenum (18) is created by, in combination, a hollow front face (3) of the disc (2), which is concave in an annular region at mid-height, and the hollow portion of the annular cover plate (20) mounted on the front face of the disc (2) over the concave region. As will be seen from the drawing of FIG. 1 in addition to the concave portion (21) the cover plate (20) comprises a bifurcated outer circumferential formation, generally indicated at (26), consisting of a continuous outer rim (28) and spaced a little way behind the rear face of rim (28) an annular array of bayonet connection tabs (30).

The radially outer side of the plenum volume (18) is sealed by the cover plate outer rim (28) which is urged against the adjacent face of the rim (8) of disc (2). The sealing face of rim (28) may, as in the illustrated embodiment, contain a continuous groove housing a seal ring (27).

The cover plate (20) is mounted on the disc (2) at its outer circumference by means of a circumferential bayonet connection in which the bayonet tabs (30) carried by the cover plate are engaged with a corresponding array of dentils or tabs (32) formed on the front face of the disc (2). This form of bayonet mounting is well known in the art and, therefore, will not be further described here.

The radially inner circumference of the plenum volume (18) is sealed by an assembly according to the present invention. The cover plate (20) has an inner circumferential rim which comprises a short, axially extending cylindrical lip (34) which is joined by an inwardly curved part (36) to the main hollow portion (21) of the cover plate. On the interior of the cylindrical part (34) there is formed a radially inwardly depending, annular flange (38). The cylindrical part (34) co-operates with an annular land (40) formed around the hub (4) of the disc, the upper surface of which is at substantially the same radius as the interior of the cylindrical portion or lip (34) on the cover plate. When assembled the cover plate (20) fits closely onto the annular land (40). The disc hub (4) also comprises an annular lip (42) spaced a short distance in front of the annular land (40) thus forming a continuous annular groove (44). When the cover plate (20) is in place on the disc the flange (38) inside the cylindrical part (34) circumscribes the radially outer extent of the groove (44). The inner rim of the cover plate is then secured by an expanding, retaining ring or split ring (46) fitted into the groove (44) and which engages the flange (38).

Before the split ring (46) is fitted the cover plate (20) has a limited degree of axial movement, relative to the disc (2), which is provided by the inherent resilience of the design and material of the cover plate (20). In order to fully complete the assembly process an axial load must be applied to the cover plate (20) towards its radially inner circumference to allow the split ring (46) to be properly positioned with respect to the cover plate flange (38) and the disc groove (44).

The split ring (46) is formed as a gapped ring with a generally L-shaped cross section comprising a longer upright portion **(46*a*) and a shorter axially extending foot (46*b*). The foot portion (46*b*) has a radially outward facing surface (46*c*) which abuts the under surface of the flange (38) when the ring is expanded on assembly. The forward side of the upright portion (46*a*) is formed with a slight outward step or lip (46*d*) or shoulder at an approximately mid-height circumference which divides that side into two concentric inner and outer annular faces (46*e*, 46*f*) respectively. The end faces (48, 50) of the ring (46) are spaced apart by a gap (52**) which varies in width according to the amount of compression to which the ring is subject.

The dimensions affecting fit and relative rotation for bayonet location are such that in a cold-build condition the cover plate (20) and disc (2) are not a tight fit, at least they exert no residual force one upon the other until the expanding ring (46) has been fitted. This ring is constructed of material such that it possesses, and in use retains, an inherent spring or resilience. During initial stages of assembly the ring (46) is passed over the lip (42) on the disc hub (4) in front of the groove (44) and is positioned in the groove. Then, using a suitable or special tool (not shown) which is engaged with tool slots (47) formed in the ring, the diameter of the ring (46) is compressed within the dimensions of the groove (44) so that the cover plate (20) can pass over it. The cover plate (20) is then located on the disc and the bayonet mounting on the outer rim is engaged by rotating the whole disc. The diameter of the innermost circumference of the flange (38) and the upstanding lip (42) are sized so that the flange (38) just passes over the lip (42). The internal diameter of the cylindrical section (34) of the cover plate and external diameter of the upper surface (41) of the annular land (40) on the disc are substantially equal so that the cover plate section (34) can be fitted onto the land (40). The ring compressing tool is then withdrawn, releasing the ring. However, inherent resilience of the cover plate biases the flange (38) towards the inner face (43) of the lip (42) thus trapping the ring (46) against this lip.

In order for the ring (46) to spring outwards an axial load opposing the inherent bias force of the cover plate is applied to the cover plate (20) at the inner diameter in a direction towards the face (3) of the disc (2). When this load exceeds the bias force the flange (38) releases the ring (46) which then is temporarily free to expand as far as the inner face of the cylindrical portion (34) of the cover plate will allow or until the surface (46*c*) of the ring foot (46*b*) engages the underside of cover plate flange (38). With the ring in position the axial load applied to the cover plate is released and the cover plate moves back into place trapping the ring (46) between the front face of flange (38) and the inner face (43) of the lip (42) on the disc. Thus, when assembly is complete the cover plate (20) remains in a stressed condition which creates a rearwardly directed load at its outer diameter, urging the outer rim (28) against the face of disc rim (8) forming an outer radius seal, and also acting in an axial direction through the blade roots (12) and into the outer diameter of a second cover plate (21) on the rear of the disc (2). This residual stress in the cover plate (20) is also exerted as a forward acting load through the flange (38) onto the spring ring (46) urging it against the annular lip (42) on the disc (2) thus forming an inner radius seal. The radially inner rim of the cover plate (20) is sealingly engaged with the web (6) of the disc adjacent the hub (4) by means of outwardly expanding spring clip (46). These cover plate loads help the cover plate (20) to seal against the disc (2) at engine speeds by reducing a tendency for centrifugal loading to cause the cover plate to warp under stress and "lift-off" the forward faces of the blades. When the centrifugal loading exceeds the built-in stress in the cover plate (20), further lifting-off is prevented by the bayonet features (30, 32) at the outer radius.

In the assembled state the residual load exerted by the cover plate flange (38) on the ring portion (46*a*) urges the ring face (46*f*) against the disc lip (42). In the event of the ring, (46) breaking into pieces this cover plate load remains thereby tending to aid retention of the pieces in situ. Also the ring step or lip (46*d*) will tend to engage the corner of the disc lip (42) to prevent the ring pieces dropping into the well of the groove (44) when the engine is stationary, even if the cover plate load has reduced due to creep.

In order to prevent the ring rotating within the groove (44) an anti-rotation key (54) is provided which positively engages with both a blind slot recess (56) formed in the disc land (46) and with the cover plate flange (38). A tongue (55) extends axially from one end of the key into the ring gap (52). Basically the key (54) comprises a body in the shape of a rectangular cuboid, the dimensions of which allow a close fit into the disc slot or recess (56). The flange (38) is also discontinuous and is formed with a gap through which the key (54) passes. The tongue (55) is also rectangular and its width in the circumferential direction is chosen to closely fit into the ring gap (52) in the fully assembled arrangement. By protruding into the ring gap (52) the key (54) inhibits angular rotation of the ring (46) and facilitates less out of balance correction at build and out of balance as a result of creep. The lip (46*d*) on ring (46) in combination with the key (54) is effective in the event of a ring breaking into segments to prevent broken sections of the ring dropping into the well of the groove (44). Without such a key the ring (46), whether broken or not, could conceivably rotate due, for example to start up inertia loads exceeding frictional resistance of the ring faces with the cover plate flange and the disc lip and this could lead to significant imbalance.

The gap in the cover plate flange (38) is angularly located relative to the dentils or tabs (16) on the cover plate such that upon the cover plate being mounted on the face of disc (2) by means of the bayonet location, and turned into position, the gap is aligned with slot (56) in the disc land (40). The key (54) may then be inserted in an axial direction through both gaps. The axial length of the key (54) is sufficient so that when fully seated in the disc slot (56) it extends through the cover plate flange gap (50) and the projecting tongue (55) is located above the groove (44). When the ring (46) is released to expand to its normal assembled position the end faces (48, 50) lie on opposite sides of the tongue belonging to the anti-rotation key (54).

The metal alloy split ring (46) is composed of material which retains sufficient spring and resilience during its working life. The ring has a generally L-shaped cross-section, as is visible on the shaded section in FIG. 2. The cross-section shape provides for two radially outward facing surfaces (46*c*, 46*g*) at stepped radii. The circumferential length of the ring is such that in its uncompressed condition the gap (52) is narrower than the gap in the cover plate flange (38) and the width of the anti-rotation key (54). The radius of the ring in the same condition is such that one or the other or both of the stepped outward facing surfaces (46*c*, 46*g*) will contact the radially inward facing surfaces of the cylindrical portion (34) of the cover plate and its flange (38).

As previously mentioned during assembly the split ring (46) is sprung into the groove (44) on disc (2). It is then compressed by means of the special tool engaged with tooling slots (47) to allow the cover plate to be fitted onto the disc (2). The cover plate is then rotated to engage the bayonet fittings (30, 32). In this phase of the assembly the ring (46) is held compressed into the well of groove (44) so that the inner circumference of flange (38) is able to pass over the top surface (46*g*) of the ring. With the ring still compressed the key (46) is inserted through the gap in the flange (38) and into the disc slot (56). When the ring is released from the compressing tool it expands until radially outward facing surfaces (46*c*, 46*g*) engage the underside of the cover plate flange (38), or the underside of the cylindrical portion (34) of the cover plate, or both. As for axial movement the inner axial surface (46*e*) on the side of the split ring (46) engages an inward facing surface (43) on the lip (42) which bounds the groove (44). In this way the split ring is positioned to at least partially obstruct the key slots and thereby to engage the anti-rotation key (54) and the disc (2) in opposing axial directions to retain the key in position. Centrifugal force generated as a result of rotation of the assembly reinforces the inherent force urging the ring into engagement and more positively resists movement of the anti-rotation key (54).

With the cover plate (20) and anti-rotation key (54) in position the split-ring (46) is released from its compressing tool and allowed to expand into contact with the under-surfaces of the cover plate as described above. In particular, the ring gap (52) opens to a gap less than the width of the key (54) thereby retaining the key in place and preventing it becoming disengaged from the slot (56) and gap (52).

Although at engine operating speeds the assembly components are subject to centrifugal forces and some relative movements take place, for example of the cover plate (20) with respect to the disc (2) the effect on the split ring (44) is merely to urge it more firmly into engagement with the underside of the cover plate.

What is claimed is:

1. A rotary assembly comprising a disc formed with a plurality of concentric features on one side thereof for mounting a cover plate by means of bayonet connections at a first radius and a split ring at a second radius including an anti-rotation key which engages with the disc, the cover plate and the split ring, wherein the anti-rotation key is engaged with a slot formed in the face of the disc and with a slot formed in the cover plate.

2. A rotary assembly as claimed in claim 1 wherein the split ring is arranged to engage the anti-rotation key whereby to maintain engagement of the anti-rotation key with the disc and the cover plate.

3. A rotary assembly as claimed in claim 1 wherein the first radius at which bayonet connection is formed is radially outwards of the second radius at which the split ring is located and the split ring is outwardly expanding.

4. A rotary assembly as claimed in claim 1 wherein the split ring is arranged to engage either the cover plate or the disc in a radial direction and the disc and the anti-rotation key in opposing axial directions.

5. A rotary assembly as claimed in claim 1 wherein the split ring is outwardly expanding and a concentric feature at the second radius comprises an outward opening groove formed in the disc into which the outwardly expanding split ring may be contracted during assembly of the cover plate.

* * * * *